US010299025B2

(12) United States Patent
Sakai et al.

(10) Patent No.: US 10,299,025 B2
(45) Date of Patent: May 21, 2019

(54) WEARABLE ELECTRONIC SYSTEM

(71) Applicant: Samsung Electronics Co., Ltd., Suwon-si, Gyeonggi-do (KR)

(72) Inventors: Ryutaro Sakai, Palo Alto, CA (US); Alex Millie, San Francisco, CA (US); Richard Overcash, San Francisco, CA (US)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/449,079

(22) Filed: Jul. 31, 2014

(65) Prior Publication Data

US 2015/0230019 A1 Aug. 13, 2015

Related U.S. Application Data

(60) Provisional application No. 61/937,389, filed on Feb. 7, 2014.

(51) Int. Cl.
*H04R 1/10* (2006.01)

(52) U.S. Cl.
CPC ..... *H04R 1/1041* (2013.01); *H04R 2420/07* (2013.01)

(58) Field of Classification Search
CPC ..... H04R 5/033; H04R 1/1041
USPC ..... 381/74
See application file for complete search history.

(56) References Cited

U.S. PATENT DOCUMENTS 6,707,924 B1 3/2004 Okiebisu
6,754,632 B1 6/2004 Kalinowski et al.
7,650,007 B2 1/2010 Iulliis et al.
7,739,723 B2 6/2010 Rogers
7,920,903 B2 4/2011 Ueda et al.
7,953,231 B2 5/2011 Ishida
8,023,895 B2 9/2011 Smith et al.
8,086,288 B2 12/2011 Klein
8,134,593 B2 3/2012 Otsuki
8,315,416 B2 11/2012 Lee
(Continued)

FOREIGN PATENT DOCUMENTS

CN 2728145 Y 9/2005
CN 201504305 U 6/2010
(Continued)

OTHER PUBLICATIONS

AMKETTE AEML, "Truebeats Slix Bluetooth Headset—AMETTE", 2011, pp. 1-2, Amketta, India (downloaded from http://www.amkette.com/product.jsp?id=206 on Apr. 8, 2015).
(Continued)

*Primary Examiner* — Simon King
(74) *Attorney, Agent, or Firm* — Sherman IP LLP; Kenneth L. Sherman; Steven Laut

(57) ABSTRACT

An electronic wearable device includes an electrical cord for carrying electrical signals. An electrical power module includes an interface for detachable connection to the electrical cord. A first audio module includes an interface for detachable connecting to the electrical cord. A second audio module includes an interface for detachable connecting to the electrical cord. The electrical cord is configured to support the first audio module and the second audio module thereon. A controller module controls the first audio module and the second audio module.

20 Claims, 10 Drawing Sheets

(56) References Cited

U.S. PATENT DOCUMENTS

| | | | | |
|---|---|---|---|---|
| 8,378,807 | B2 | 2/2013 | Lee et al. | |
| 8,428,053 | B2 | 4/2013 | Kannappan et al. | |
| 8,588,824 | B2 | 11/2013 | Rowe | |
| 8,652,062 | B1 | 2/2014 | Holder | |
| 8,718,930 | B2 | 5/2014 | Tachibana et al. | |
| 8,761,430 | B2 | 6/2014 | Zimmerman | |
| 8,913,734 | B2 | 12/2014 | Thange | |
| 8,931,896 | B2 | 1/2015 | Blum et al. | |
| 8,947,382 | B2 | 2/2015 | Winkler et al. | |
| 9,013,264 | B2 | 4/2015 | Parshionikar et al. | |
| 9,235,241 | B2 | 1/2016 | Newham et al. | |
| 2006/0251277 | A1 | 11/2006 | Cho | |
| 2006/0251283 | A1 | 11/2006 | Yeh | |
| 2007/0021073 | A1 | 1/2007 | Gratton | |
| 2008/0317274 | A1 | 12/2008 | Kim | |
| 2009/0296951 | A1 | 12/2009 | De Haan | |
| 2010/0020982 | A1 | 1/2010 | Brown et al. | |
| 2010/0029299 | A1 | 2/2010 | Riise et al. | |
| 2010/0166207 | A1 | 7/2010 | Masuyama | |
| 2011/0144779 | A1* | 6/2011 | Janse | G11B 20/10009 700/94 |
| 2011/0216931 | A1 | 9/2011 | Bui | |
| 2011/0299707 | A1 | 12/2011 | Meyer et al. | |
| 2011/0320444 | A1 | 12/2011 | Yehaskel et al. | |
| 2012/0027215 | A1* | 2/2012 | Sim | H04R 1/1041 381/55 |
| 2012/0046792 | A1 | 2/2012 | Secor | |
| 2012/0052810 | A1 | 3/2012 | Schreduder | |
| 2012/0191454 | A1 | 7/2012 | Gabara et al. | |
| 2012/0229248 | A1 | 9/2012 | Parshionikar et al. | |
| 2012/0316661 | A1 | 12/2012 | Rahman et al. | |
| 2012/0317024 | A1 | 12/2012 | Rahman et al. | |
| 2013/0129110 | A1 | 5/2013 | Harper | |
| 2013/0159885 | A1 | 6/2013 | Yerli | |
| 2013/0176106 | A1 | 7/2013 | Schultz et al. | |
| 2013/0194066 | A1 | 8/2013 | Rahman et al. | |
| 2013/0194310 | A1 | 8/2013 | Vasudevan et al. | |
| 2013/0198694 | A1 | 8/2013 | Rahman et al. | |
| 2014/0070957 | A1 | 3/2014 | Longinotti-Buitoni et al. | |
| 2014/0119554 | A1 | 5/2014 | Chan et al. | |
| 2014/0156084 | A1 | 6/2014 | Rahman et al. | |
| 2014/0177813 | A1 | 6/2014 | Leeds et al. | |
| 2014/0233752 | A1* | 8/2014 | Seo | H04M 1/035 381/74 |
| 2014/0254853 | A1 | 9/2014 | Blonder et al. | |
| 2015/0146908 | A1* | 5/2015 | Kalhok | H04R 1/1041 381/374 |
| 2015/0230022 | A1 | 8/2015 | Sakai et al. | |
| 2015/0358716 | A1 | 12/2015 | Zhu | |

FOREIGN PATENT DOCUMENTS

| | | | |
|---|---|---|---|
| CN | 103167365 | A | 6/2013 |
| CN | 203406994 | U | 1/2014 |
| CN | 102301743 | B | 6/2014 |
| CN | 103517174 | B | 4/2017 |
| EP | 2506597 | A1 | 10/2012 |
| JP | 3154506 | U | 9/2009 |
| JP | 3155288 | U | 10/2009 |
| KR | 200191799 | Y1 | 8/2000 |
| KR | 100617576 | | 8/2006 |
| WO | 2011000174 | A1 | 4/2011 |
| WO | 2012015257 | A2 | 2/2012 |
| WO | 2014107876 | A1 | 7/2014 |

OTHER PUBLICATIONS

International Search Report and Written Opinion dated Jan. 9, 2015 for International Application No. PCT/KR2014/009565 from Korean Intellectual Property Office, pp. 1-10, Daejeon, Republic of Korea.

International Search Report and Written Opinion dated Jan. 9, 2015 for International Application No. PCT/KR2014/009517 from Korean Intellectual Property Office, pp. 1-16, Daejeon, Republic of Korea.

Pitzer, J.W. et al., "The Next Big Thing—Wearables Are in Fashion", Credit Suisse Securities Research & Analytics, May 17, 2013, pp. 1-49, Equity Research, United States.

Li, K.A. et al., "PeopleTones: A System for Detection and Notification of Buddy Proximity on Mobile Phones", Proceedings of the 6th International Conference on Mobile Systems, Applications, and Services (MobiSys'08), Jun. 17, 2008, pp. 160-173, ACM, United States.

Sawhney, N. et al., "Speaking and Listening on the Run: Design for Wearable Audio Computing", Proceedings of the ISEC '98 International Symposium on Wearable Computing, Oct. 19-20, 1998, pp. 1-8, IEEE, United States.

International Search Report and Written Opinion dated Oct. 27, 2015 for International Application No. PCT/KR2015/007398 from Korean Intellectual Property Office, pp. 1-10, Daejeon, Republic of Korea.

U.S. Non-Final Office Action for U.S. Appl. No. 14/595,894 mailed Jul. 29, 2016.

U.S. Final Office Action for U.S. Appl. No. 14/595,894 dated Nov. 16, 2016.

U.S. Non-Final Office Action for U.S. Appl. No. 14/595,894 dated Mar. 30, 2017.

Extended European Search Report dated Oct. 25, 2017 for European Application No. 15786698.9 from European Patent Office, pp. 1-6, Munich, Germany.

U.S. Non-Final Office Action for U.S. Appl. No. 14/595,894 dated Jan. 9, 2018.

U.S. Advisory Action for U.S. Appl. No. 14/595,894 dated Nov. 2, 2017.

U.S. Final Office Action for U.S. Appl. No. 14/595,894 dated Aug. 8, 2017.

Extended European Search Report dated Feb. 22, 2018 for European Application No. 15824223.0 from European Patent Office, pp. 1-9, Munich, Germany.

U.S. Final Office Action for U.S. Appl. No. 14/595,894 dated May 25, 2018.

Chinese Office Action dated Jul. 13, 2018 for Chinese Patent Application No. 201480075042.X from Chinese Patent Office, pp. 1-24, Beijing, China (English-language translation included pp. 1-19).

U.S. Advisory Action for U.S. Appl. No. 14/595,894 dated Aug. 10, 2018.

Chinese Office Action dated Oct. 26, 2018 for Chinese Patent Application No. 201580034122.5 from Chinese Patent Office, pp. 1-25, Beijing, China (English-language translation included pp. 1-15).

U.S. Non-Final Office Action for U.S. Appl. No. 14/595,894 dated Nov. 6, 2018.

Chinese Office Action dated Jan. 8, 2019 for Chinese Patent Application No. 201480075042.A from Chinese Patent Office, pp. 1-21, Beijing, China (English-language translation included pp. 1-14)

European Examination Report dated Feb. 22, 2019 for European Patent Application No. 148825112.7 from European Patent Office, pp. 1-5, Netherlands.

* cited by examiner

WEARABLE ELECTRONIC SYSTEM

CROSS-REFERENCE TO RELATED APPLICATIONS

This application claims the priority benefit of U.S. Provisional Patent Application Ser. No. 61/937,389, filed Feb. 7, 2014, which is incorporated herein by reference in its entirety.

TECHNICAL FIELD

One or more embodiments relate generally to audio devices, and in particular, to multi-mode wearable devices.

BACKGROUND

Personal listening devices, such as headphones, headsets, and ear buds, are used to reproduce sound for users from electronic devices, such as music players, recorders, cell phones, etc. Most personal listening devices simply pass sound from a sound producing electronic device to the speaker portions of the listening device.

SUMMARY

One or more embodiments relate to a wearable audio device. In one embodiment, an electronic wearable device includes an electrical cord for carrying electrical signals. An electrical power module includes an interface for detachable connection to the electrical cord. In one embodiment, a first audio module includes an interface for detachable connecting to the electrical cord. A second audio module includes an interface for detachable connecting to the electrical cord. The electrical cord is configured to support the first audio module and the second audio module thereon. A controller module controls the first audio module and the second audio module.

In another embodiment, a system that comprises an electronic wearable device that is configured for communicating with an electronic device. The wearable device comprises an electrical cord for carrying electrical signals. An electrical power module includes an interface for detachable coupling to the electrical cord. A first audio module includes an interface for detachable coupling to the electrical cord. A second audio module includes an interface for detachable coupling to the electrical cord. The electrical cord is configured to support the first audio module and the second audio module thereon. A controller module controls the first audio module and the second audio module.

In one embodiment, a wearable device comprises an electrical cord that carries electrical signals. A first audio module includes an interface for detachable coupling to the electrical cord. A second audio module includes an interface for detachable coupling to the electrical cord. The first audio module and the second audio module each include one or more elements for removably coupling to one another.

These and other features, aspects and advantages of the one or more embodiments will become understood with reference to the following description, appended claims and accompanying figures.

DETAILED DESCRIPTION

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

One or more embodiments relate to a wearable audio device. In one embodiment, an electronic wearable device includes an electrical cord for carrying electrical signals. An electrical power module includes an interface for detachable connection to the electrical cord. In one embodiment, a first audio module includes an interface for detachable connecting to the electrical cord. A second audio module includes an interface for detachable connecting to the electrical cord. The electrical cord is configured to support the first audio module and the second audio module thereon. A controller module controls the first audio module and the second audio module.

Figure 1:
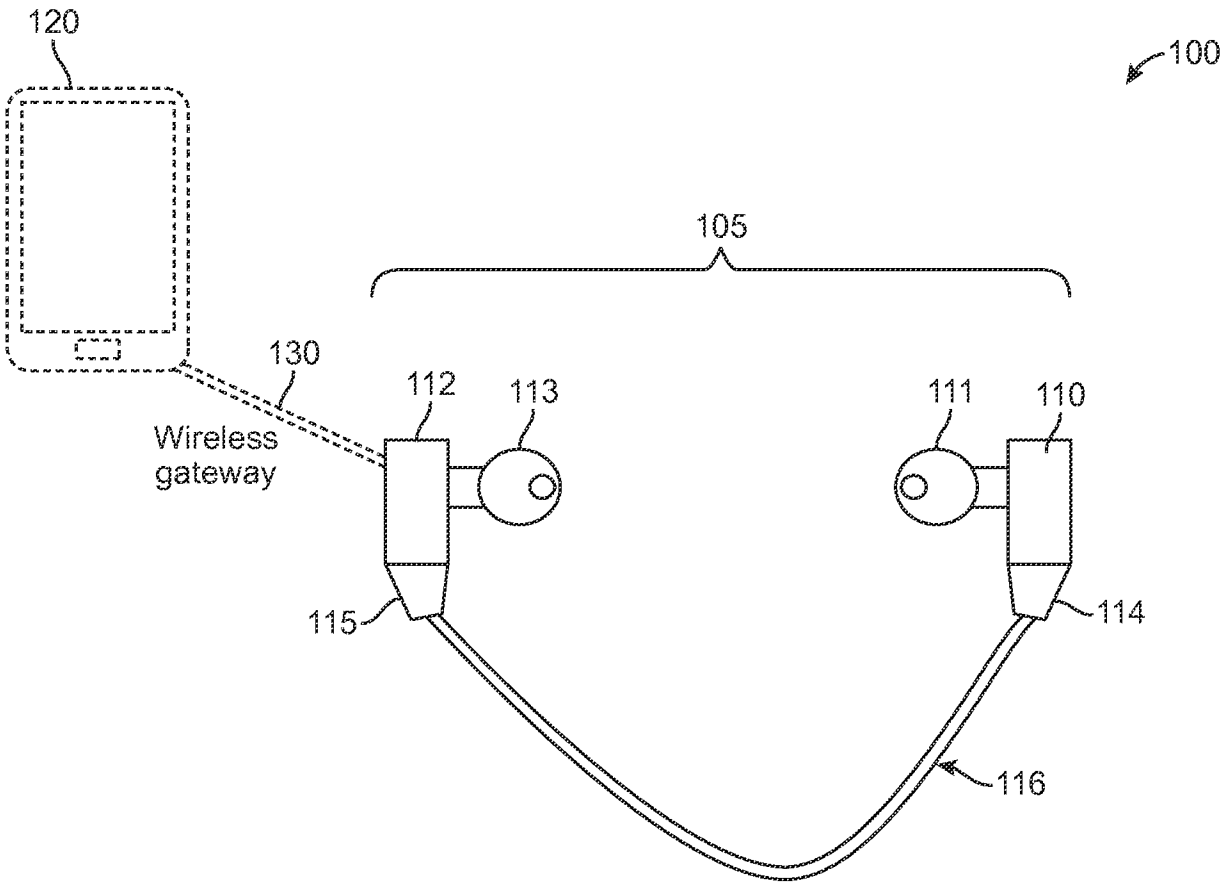
FIG. 1 shows a wearable device system for audio communication, according to an embodiment.

FIG. 1 shows a wearable device system 100 for audio communication, according to an embodiment. In one embodiment, the wearable device 105 includes audio output devices such as ear buds 111 and 113, a swappable cord (or cable) 116 therebetween, at least one battery coupled with an audio module 110, a controller module coupled with an the audio module 110 and/or the audio module 112 that controls the audio module 110 and/or the audio module 112 with, for example, controls including audio controls (e.g., buttons, touch interfaces, microphone (e.g., using voice recognition), motion sensing, etc.). In one embodiment, the controls are placed near the front of the cord or cable when worn by a user as a necklace for easy and comfortable access. In another example, the controls are positioned on either or both audio modules 110 and 112. The ear buds 111 and 113 may be attached to the swappable cord 116 through a data connection, (e.g., micro USB, or any other suitable connectivity). In one example, the audio module 110 is connected with a connector 114 (e.g., male micro USB, female micro USB, any other suitable connectors, etc.) and the audio module 112 is connected with a connector 115 (e.g., female micro USB, male micro USB, etc.). In one example, the wearable device 105 may communicate with an electronic host device 120 (e.g., a smart phone, a tablet device, a computing device, an appliance, a wearable device (e.g., a wrist or pendant device), a vehicle, etc.) using a communication medium 130, such as a wireless gateway (e.g., Bluetooth®, etc.). In one embodiment, the wearable device 105 is wearable by a user for listening to audio through one or both of the ear buds 111 and 112.

In one embodiment, the cord or cable 116 may include a cable running through the cord or cable for communication between the audio modules 110 and 112. In one embodiment, the cord or cable 116 may include material overmolded of other soft material (e.g., foam, gel, plastic, other molded material, etc.) for wearable comfort. In one example, the cord or cable 116 may be shaped for comfortable fit when placed against a user's neck. In one embodiment, the cord or cable 116 is designed based on specific uses, such as water resistant or waterproof for watersport use, includes additional padding or material for jogging or sports/activities that would cause the cable or cord 116 to move when the wearable device 105 is in use (e.g., ear buds deployed in a user's ear, worn as a necklace and audio modules 110 and 112 are powered on, in stand-by or operational, etc.). In one embodiment, the cord or cable 116 may include shape-memory alloy or superelastic (or pseudoelastic) material, such as nitinol.

In one embodiment, the wearable device 105 has a weight that is ergonomically distributed between the cable or cord 116 and the ear buds 111 and 113 when worn by a user (either as a necklace, worn in one ear, or worn in both ears).

Figure 2B:
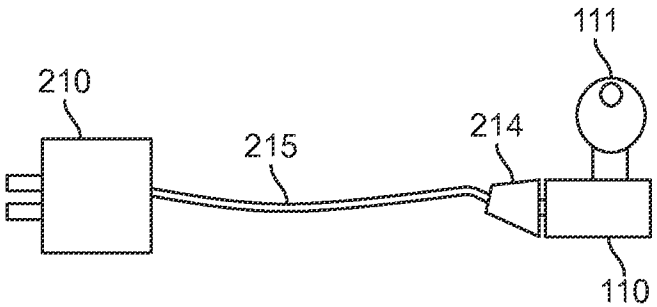
FIG. 2B shows an audio module that includes a battery and ear bud connected for charging for a wearable device for audio communication, according to an embodiment.
Figure 2C:
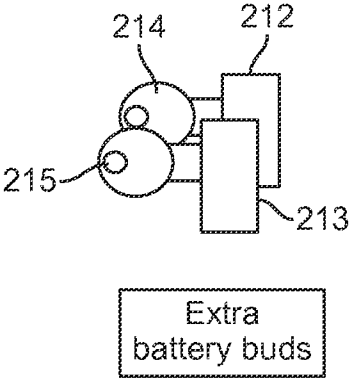
FIG. 2C shows extra audio modules that include a battery and ear bud for a wearable device for audio communication, according to an embodiment.
Figure 2A:
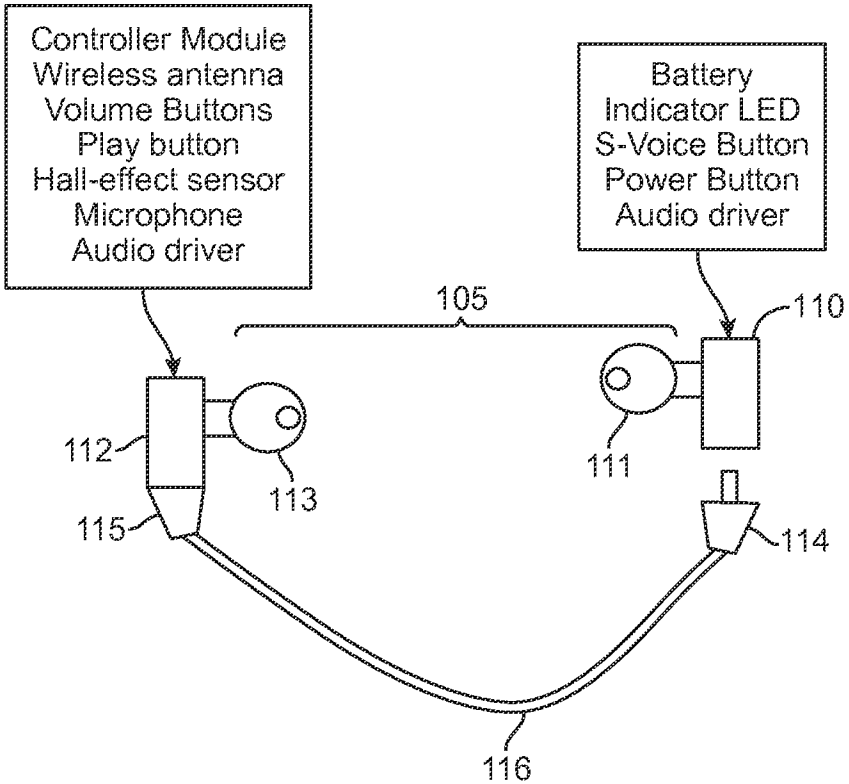
FIG. 2A shows an audio module that includes a battery and ear bud disconnected for a wearable device for audio communication, according to an embodiment.

FIG. 2A shows an audio module 110 that includes a battery and ear bud 111 disconnected for a wearable device 105 for audio communication, according to an embodiment. In one example embodiment, the audio module 110 may include a battery (e.g., rechargeable battery, replaceable battery, etc.), indicator LED(s), voice activation button (e.g., digital assistant activation, voice command acceptance trigger, etc.) or touch activated device (e.g., resistive digitizer, touchscreen button, capacitive area or button, etc.), power button or touch activated device, and an audio driver. As shown, the connector 114 (e.g., a male micro USB connector) is disconnected from the audio module 110. In one example, the capacitive area or button and resistive digitizer may be programmable to serve as controls (e.g., volume, power, microphone control, mute, directional control (forward/back), etc.).

In one embodiment, the cord or cable 116 may include one or more haptic elements including a haptic motor for haptic notifications (e.g., low battery warning, incoming messages (e.g., voicemail or text message, incoming calls, specific caller, timer notifications, distance notification, etc.). In one embodiment, the haptic element(s) may be located behind the neck when the wearable device 105 is worn by a user, spread out around the cable or cord 116, or a single haptic element placed in a desired or configurable location on the wearable device 105.

In one example embodiment, the audio module 112 may include a controller module, connection module, volume buttons or touch sensitive controls, play button or touch control, a hall-effect sensor, one or more microphones, and an audio driver. In one example embodiment, the audio modules 110 and 112 may include other sensors, such as a motion sensor, pressure sensor, touch sensor, temperature sensor, barometric sensor, gyroscopic sensor, global positioning system (GPS) sensor or module, light sensor, etc.

In one embodiment, the connection module of one audio module (e.g., audio module 112) may comprise a wireless antenna (e.g., a Bluetooth® antenna, Wi-Fi antenna, cellular antenna, etc.) to wirelessly connect to a host device 120. Other components may include a controller module, physical buttons (configured to control volume, play music, etc.), transducers (such as a Hall-effect sensor), microphone, or audio driver. The other audio module (e.g., audio module 110) with ear bud 111 may comprise a battery for powering the wearable device 105, along with one or more indicator LEDs, physical buttons (configured to be a power button, or virtual assistant activation (e.g., S-Voice), etc.), or an audio driver.

In one embodiment, the ear buds 111 and 113 may have any type of configurations for in ear placement, over ear loops or flange, assorted sizes and materials (e.g., silicon, elastomer, foam, etc.). In one embodiment, the material of the inner ear portion of the ear bud 111 and ear bud 113 may be sized for noise cancellation along with electronic noise cancellation of the audio module 112.

FIG. 2B shows an audio module 110 that includes a rechargeable battery and ear bud 111 connected for charging for a wearable device 105 for audio communication, according to an embodiment. In one embodiment, the audio module 110 connects with a cord or cable 215 that is connected to a charging device 210 (e.g., an AC/DC adapter, USB connector or adapter, cigarette lighter adapter, solar charger, etc.). In one example, a connector 214 (e.g., a micro USB connector or other similar connector) couples to the audio module 110 via a male or female connection. In one embodiment, the battery of the audio module 110 is removable from the audio module 110 housing. In one embodiment, the audio module 110 may be adapted to use multiple batteries, different size batteries, etc.

FIG. 2C shows extra audio modules 212 and 213 that include a battery and ear bud 214 and 215, respectively, for a wearable device 105 for audio communication, according to an embodiment. In one example, the extra audio modules may be similar to any one of audio modules 110 and 112 for easy substitution. In one embodiment, the substitute audio modules 212 and 213 may be charged while an audio module 110 is in use. When the battery power runs out of the audio module 110, a user may replace the audio module 110 with one of the audio modules 212 and 213, or charge the battery in a charging case, charging platform, charging connectors, etc. In another example, the extra audio modules 212 and 213 may be similar to audio module 112 and have the same, similar or different features or functions. For example, one audio module may be adapted for Wi-Fi, while another is adapted for Bluetooth®; one audio module may have a processor and memory for particular application execution, voice recognition, more or less sound amplification, equalizer modules or fixed settings (e.g., based on genre), different driver/speaker (e.g., more bass, more mid-range, more high-range, etc. Additionally, the extra audio modules 212 and 213 may have different colors or color schemes, designs, shapes, forms, materials, etc.

Figure 3:
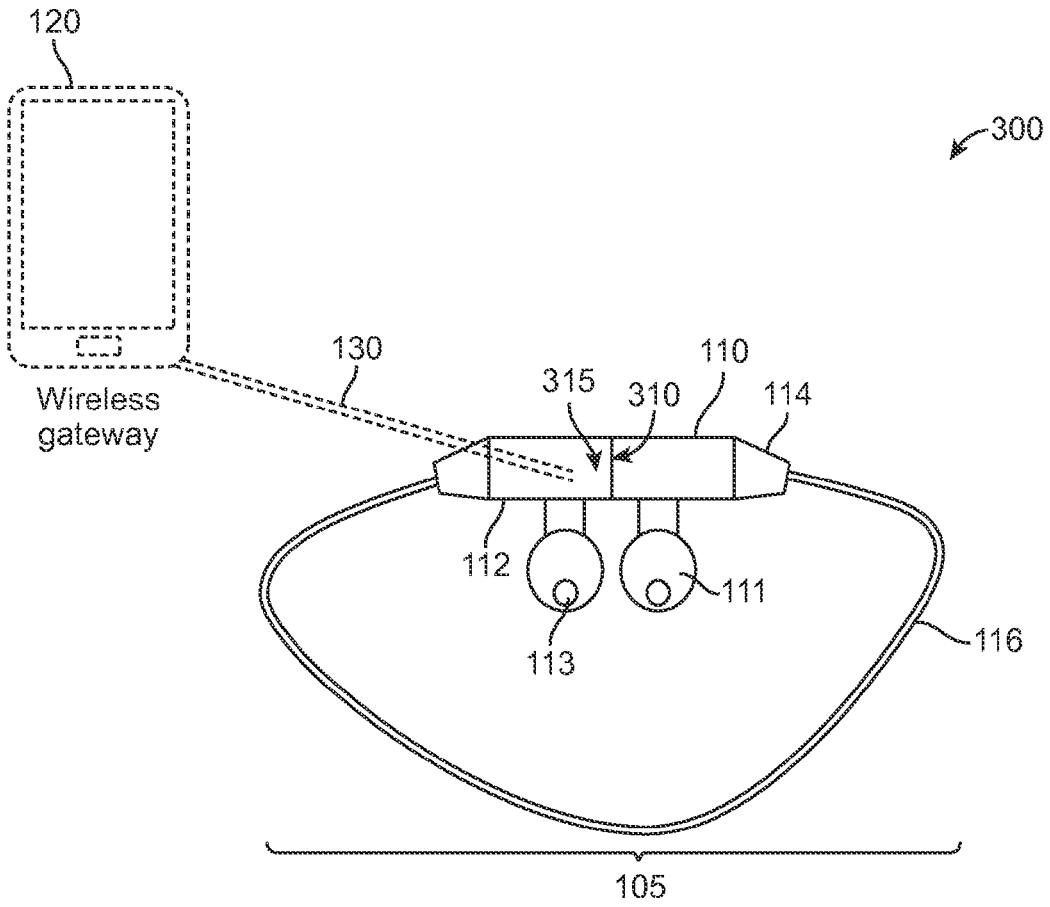
FIG. 3 shows an example system including audio modules with an ear bud and magnet for mating for the wearable device, according to an embodiment.

FIG. 3 shows an example system 300 including audio module 110 with ear bud 111 and a magnet 310 (or one or more magnetic elements) for mating with an audio module 112 with ear bud 113 and magnet 315 for the wearable device 105 for audio communication, according to an embodiment. In one embodiment the audio modules 110 and 112 include magnets for magnetically attracting one another for mating the audio modules 110, 112 ear buds 111, 113 and forming a necklace. In one example the wearable device 105 communicates with the host device 120. The user may utilize physical control buttons, touch sensitive areas or provide voice commands to the wearable device 105 for control and use. In one example, the wearable device 105 is wirelessly connected to a host device 120. In one embodiment, the wearable device 105 includes a clip (e.g., a collar clip) for reducing movement when worn by a user (e.g., when jogging, horseback riding, etc.).

In one example embodiment, instead of magnetic elements or magnets 310 and 315, other coupling elements may be used, such as removable (or breakaway) locking elements, electronic magnets, a clasp, hook and loop fastening elements, etc.

Figure 4:
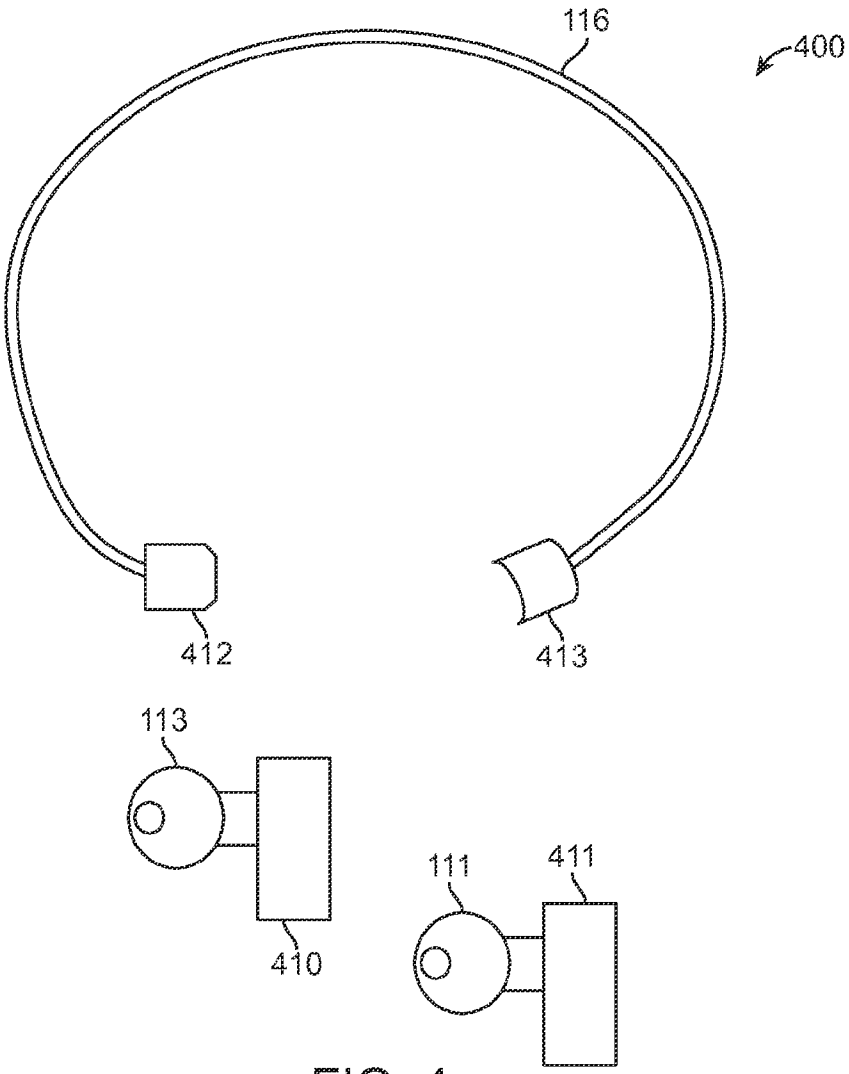
FIG. 4 shows audio modules with ear buds including a swappable cord for a wearable device, according to an embodiment.

FIG. 4 shows a wearable device system 400 including audio module 410 (e.g., similar to audio module 112) with an ear bud 113 and audio module 411 (e.g., similar to audio module 110) with ear bud 111 and swappable cord 116 for a wearable device (e.g., wearable device 105, FIG. 1), according to an embodiment. In one embodiment the wearable device includes the swappable cord 116 with a USB cable therein for connection between the ear buds 113, 111 audio modules 410 and 411. For example, the USB cable 116 may comprise a male micro USB connector 412 on one end and a female USB connector 413 on the opposite end. Corresponding connectors may be included for each audio module 410 and 411 to prevent unusable configurations, e.g., a scenario where two ear buds with batteries are attached, which would be unusable. Other connector configurations are also possible, such as male micro USB connector and a female USB connector, male or female adapters, other types of connectivity connectors/adapters, etc.

Figure 5:
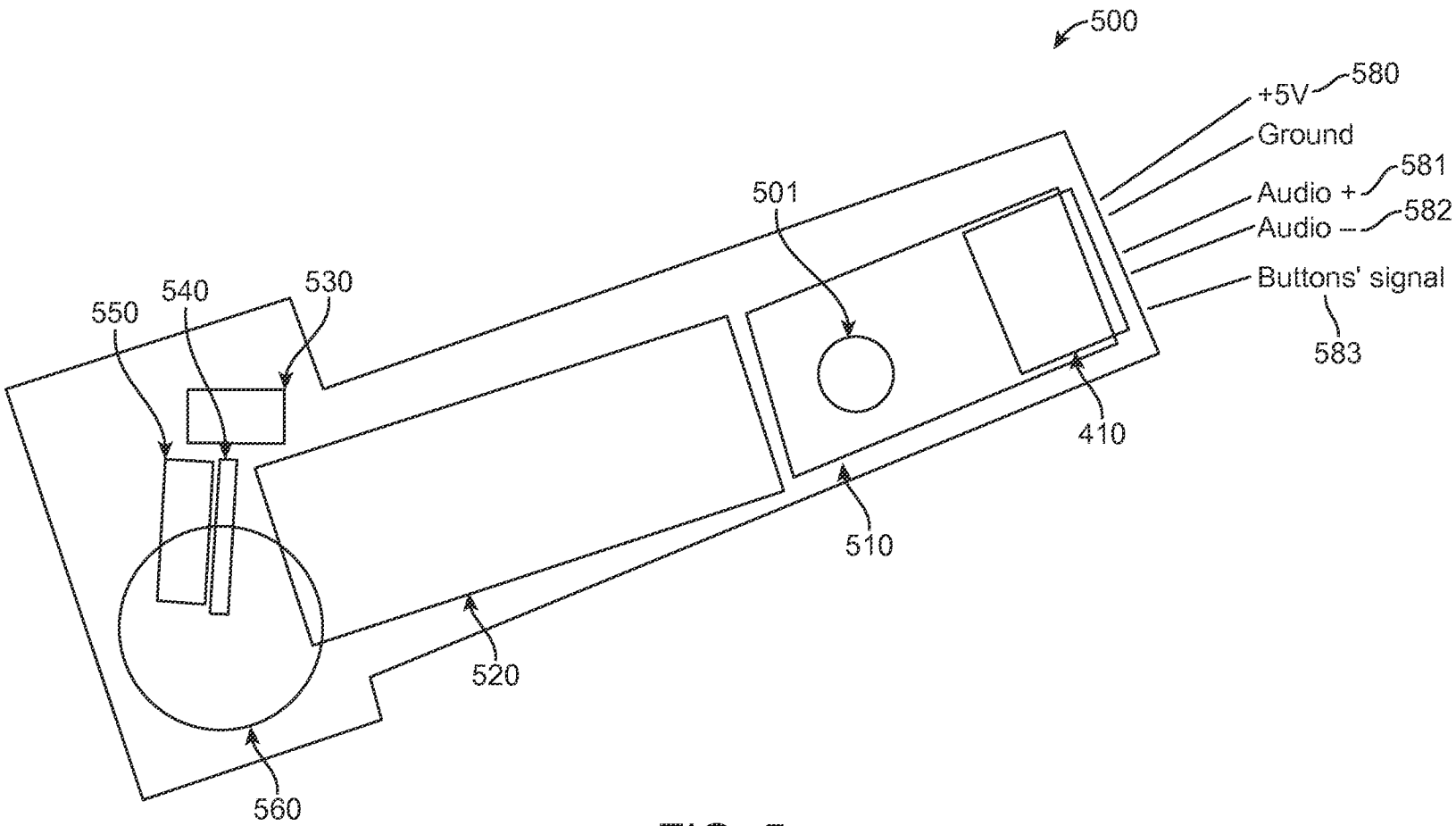
FIG. 5 shows an example of components for an audio module for an ear bud for one side of a wearable device, according to an embodiment.

FIG. 5 shows an example of components for an audio module 500 for an ear bud (e.g., ear bud 110, FIG. 3, ear bud 410, FIG. 4) for one side (e.g., right side earbud) of a wearable device (e.g., wearable device 105, FIG. 1), according to an embodiment. In one example, the audio module 500 comprises a housing surrounding the components of an ear bud (e.g., right side ear bud) with physical arrangement or layout of the functional components on a printed circuit board (PCB) 510 included within the housing. In one embodiment, the audio module 500 for an ear bud may comprise a battery 520 (e.g., a rechargeable battery, replaceable batter, etc.), physical buttons (e.g., power button 550) configured to control power or a virtual assistant, a magnet 530, an audio driver 560, a female micro USB connector 410, a PCB 510 comprising a battery charging circuit, switch component for a physical button (e.g., an s-voice button 501), solder pads to connect to the battery 520, audio driver 560, additional physical buttons or touch sensitive areas, or other components. In one embodiment, the power button 550 may use a power button snap dome for pressing the power button on/off. In one example, the audio module 500 for an ear bud has power and control connectivity within the connector (e.g., a female connector, a micro USB connector, male connector, any other suitable type of connectivity, etc.), for example: voltage and ground 580 (e.g., +5V), positive and negative audio connections 581 and 582, button signal connections 583, etc.

In one embodiment, audio module 500 the housing may be tailored for different activities for comfort and functionality. In one example, the housing for audio module 500 may have shock resistant components and ergonomic features for sports activity use (e.g., jogging, weightlifting, etc.), motorsport use (e.g., driving a vehicle, riding on/in a vehicle, boating, etc.), watersports or spa use (e.g., waterproof or water resistant housing and components), etc.

Figure 6:
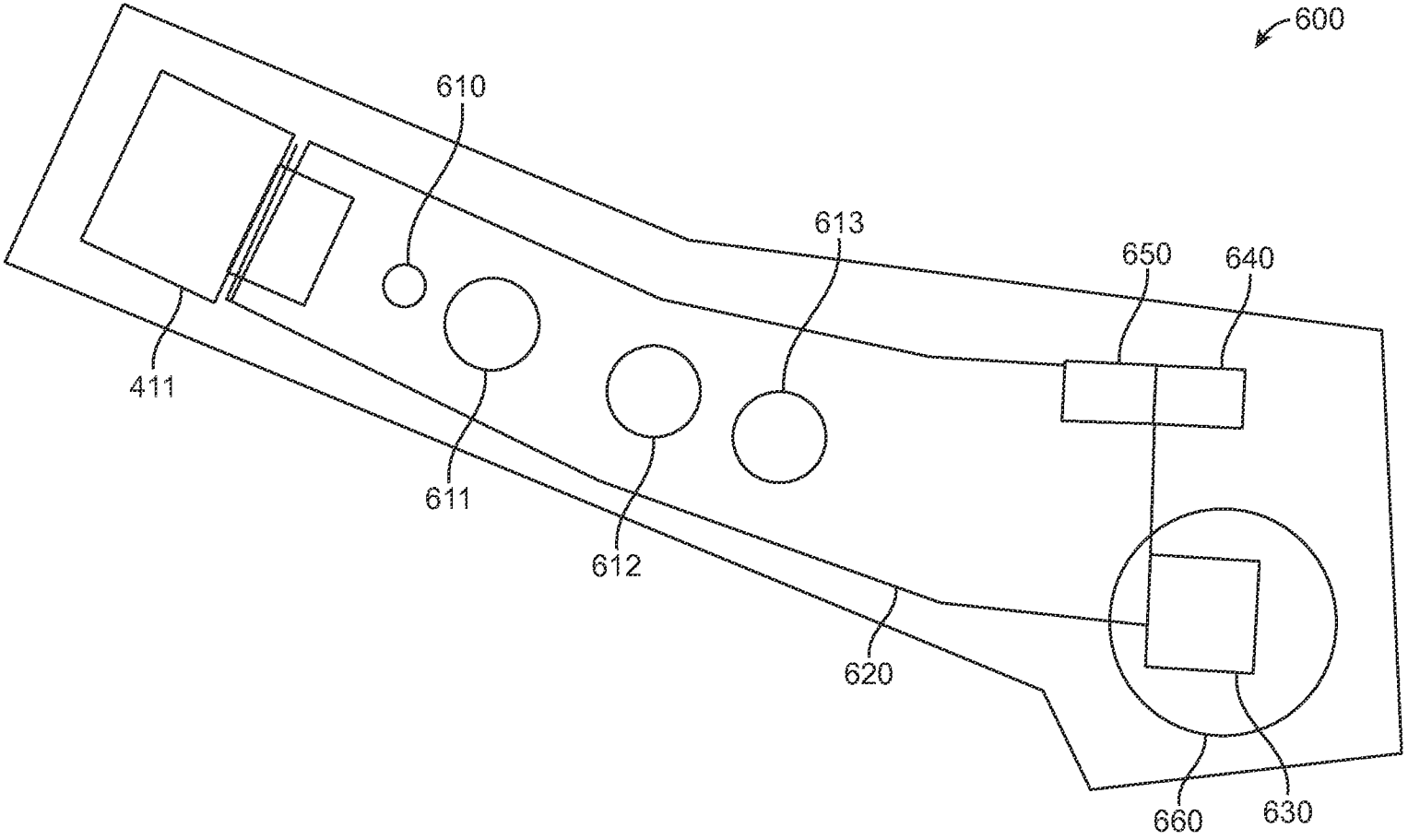
FIG. 6 shows an example of components for an audio module for an ear bud for another side of a wearable device, according to an embodiment.

FIG. 6 shows an example of components for an audio module 600 for an ear bud (e.g., ear bud 112, FIG. 3, ear bud 411, FIG. 4) for one side of a wearable device (e.g., wearable device 105, FIG. 1), according to an embodiment. In one example, the audio module 600 comprises a housing surrounding the components for an ear bud (e.g., left side ear bud) with a physical arrangement or layout of the functional components on a main PCB 620 included within the housing. In one embodiment, the audio module 600 for an ear bud may comprise a component 411 which connects to a cord or cable 116 (FIG. 1; e.g., a connector, a male micro USB connector, an adapter, any other type of suitable connectivity, etc.), one or more microphones 610, physical buttons (e.g., volume rocker buttons 611, 612, play/pause button 613, etc.), audio driver 660 (e.g., a speaker), a sensor 650 (e.g., a hall-effect sensor), a magnet 640, and wireless connectivity 630, such as an antenna, receiver, transceiver, etc. (e.g., for Wi-Fi, Bluetooth, cellular, etc.). The components comprised within the ear bud housing may be connected to a main PCB 620 which may comprise a headset microcontroller (MCU), which can control some of the operations of the wearable device, and solder pads for the audio driver 660.

In one embodiment the wearable audio modules 600 and 500 (FIG. 5) with ear buds may comprise one or more sensors for the wearable device to detect the state of the device (i.e., state detection). For example, the sensors may assist the wearable device for determining a state configuration of the wearable device (e.g., whether an ear bud is in one ear, both ear buds are in both ears, the wearable device is in a necklace configuration, or the wearable device is not worn by a user).

In one embodiment, each audio module for an ear bud has an accelerometer which senses a user's motion or audio module and ear bud orientation. In some embodiments the worn audio modules with ear buds will be in some level of constant motion or have the cord (e.g., cord 116, FIG. 1) pointed roughly downwards. Thus allowing determination of whether one, both or no ear buds are in use. In other embodiments, the audio modules and ear buds may be configured to respond to various gestures, such as double-tap, shake, or other similar gestures or movements that can be registered by the accelerometer.

In one embodiment, each audio module 500 and 600 for an ear bud comprises two microphones: one microphone that samples the outside environment, and one microphone that samples inside the ear bud. Signals are compared for selecting the best signal and further audio processing. For example, the signal comparison using a microphone differential may register a muffled noise on the microphone inside the ear bud to determine if the ear bud is in use (e.g., in a user's ear). Optionally, the microphones may be used to perform audio processing, such as noise cancellations or "listen" for voice commands. In some embodiments the microphones may be subminiature microphones, but other microphones may be utilized as well.

In one embodiment, each audio module 500 and 600 for an ear bud includes a pressure sensor. In one example, when an ear bud 111, 113 (FIG. 1) is inserted into an ear or removed from an ear, an event shows up as a pressure spike or valley. The pressure spike or valley may then be used for determining the state of the wearable device.

In one embodiment, each audio module 500, 600 for ear buds comprises an optical proximity sensor, such that when worn, a steady proximity signal is generated. In one embodiment, the optical proximity sensor may be located within the housing for the ear bud 111 and/or 113, such that when the ear buds are worn, the optical proximity sensor lies against a user's skin. In one example, the optical proximity sensors provide for determination of whether one, both or no ear buds are in use.

In one embodiment, each audio module 500 and 600 for an ear bud includes a housing element that is sensitive to touch (capacitive sensing). For example, each ear bud housing structure may comprise capacitive touch rings near the flexible ear bud portion of ear buds 111 and 113 (FIG. 1) that is inserted in a user's ear. Such structure may contact or touch a user's skin allowing determination of whether one, both or no ear buds are in use.

In one embodiment, each audio module 500 and 600 for an ear bud has a mechanical conversion module to hide the ear buds 111 and 113 (FIG. 1) in a necklace state. For example, the conversion module may comprise a magnetic snap which activate a limit switch (e.g., using a hinge) depending on whether the ear bud is in an open or closed position allowing determination of whether one, both or no ear buds are in use.

Figure 7A:
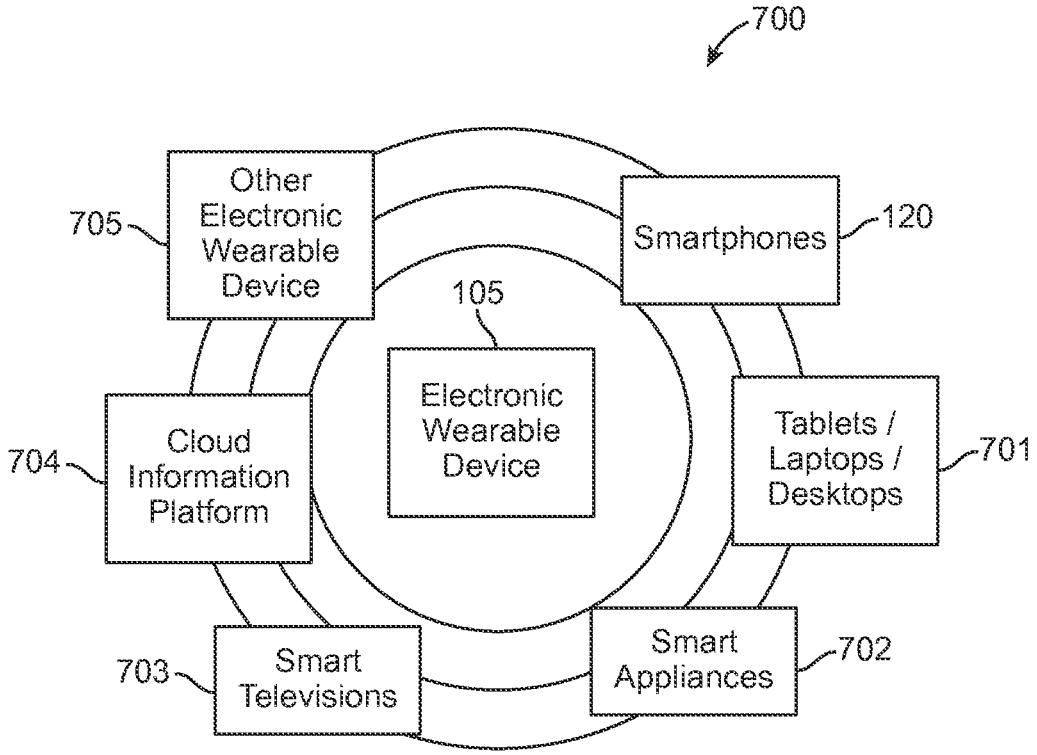
FIG. 7A shows an example computing environment or ecosystem, that provides hands free control of an ecosystem of content and devices accessible to a wearable device, according to an embodiment.

FIG. 7A shows an example computing environment or ecosystem 700, that provides hands free control of an ecosystem of content and devices accessible to a wearable device (e.g., wearable device 105, FIG. 1), according to an embodiment. In one embodiment, the electronic wearable device in conjunction with one or more host devices (e.g., smart phone 120, electronic bracelet 705, smart TV 703, tablet 701, data platform 704 (e.g., cloud information platform), smart appliances 702, automobiles/vehicles 780 (FIG. 7B), etc.) in a computing environment or ecosystem 700, provides hands free control of an ecosystem of content and devices accessible to the wearable device.

In one embodiment, the electronic wearable device may be directly connected with each host device through a communication module (e.g., Bluetooth®, Wi-Fi, Infrared Wireless, Ultra Wideband, Induction wireless, etc.). In another embodiment, the electronic wearable device may interact with other devices through a single host device (e.g., smartphone).

Figure 7B:
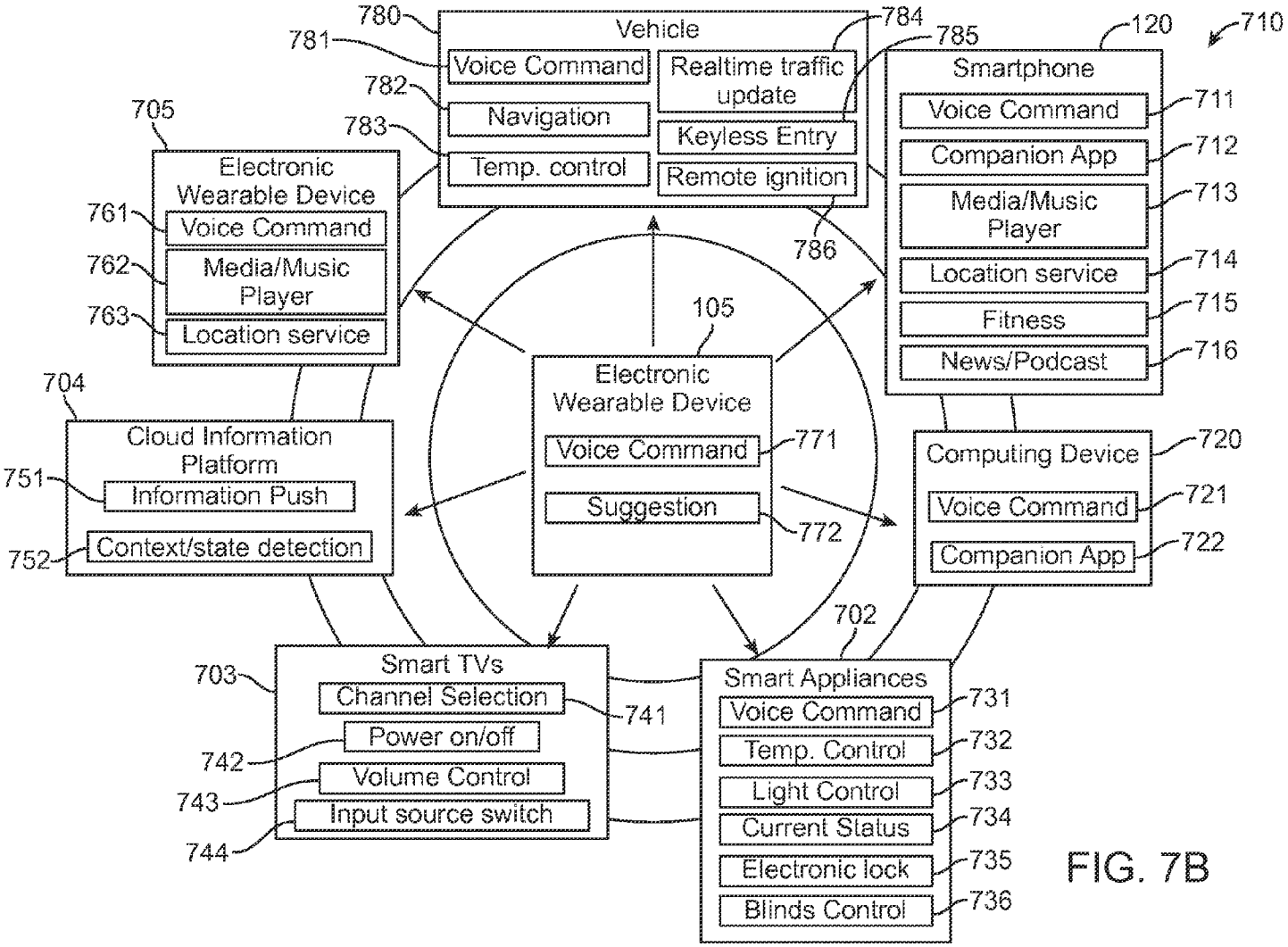
FIG. 7B shows a block diagram of an example implementation of an embodiment of the electronic wearable device in conjunction with one or more other devices, such as devices shown in FIG. 7A.

FIG. 7B shows a block diagram of an example implementation 710 of an embodiment of the electronic wearable device 105 in conjunction with one or more other devices, such as the host devices shown in FIG. 7A. In one embodiment, a voice assistant (S-voice) application or function may be implemented in the wearable device 105. The voice assistant may also have components implemented in a host device (e.g., smartphone 120, tablet or computing device 720, smart appliance 702, smart TV 703, other electronic wearable devices 705, vehicle 780, etc.) and user commands or queries (e.g., voice commands 771) may be sent or processed in the cloud information platform 704 to perform advanced voice command recognition and determining appropriate actions.

In one embodiment, the electronic wearable 105 device may comprise a suggestion application or function 772. The suggestion application or function 772 may be triggered by a physical button and provide relevant information based on location, time of day, context and activity (e.g., walking, driving, listening, talking, etc.), calendar information, weather, etc. The suggestion application or function 772 may interact with functions in connected host devices to obtain appropriate information.

In one embodiment, the companion application (e.g., companion app 712, 722) enables a user to choose services that the user desires. The companion application may also gather content from various sources from smartphone apps and cloud services. For example, for "morning readout," today's calendar events and weather are gathered prior to being called out so that a playback may be performed by the suggestion application or function 772 on the wearable device 105 immediately/smoothly without any time lag. The companion application may also facilitate other functions, such as controlling a media/music player 762, location service applications 714, 763, fitness applications 715, news/podcast applications 716, etc.

In one embodiment, the companion application may be implemented on a host device (e.g., smartphone, tablet, etc.) and may query other devices in the ecosystem. In one example, a smart phone 120 may include functions for voice command 711 (e.g., recognition, interactive assistant, etc.), location services 714, fitness applications 715 and news/podcast 716. The computing device or tablet device 720 may include voice command functionality 721 that operates with the companion app 722.

In one embodiment, the cloud information platform (info platform) 704 comprises a cloud based service platform that may connect with other devices in the ecosystem. The cloud information platform 704 may comprise information push 751 functions to push information to the electronic wearable device 105 or other host devices or assist with context/state detection through a context/state detection function 752.

In one embodiment, an audio manager function may be implemented as a component of the voice assistant function or the companion application 712, 722. The audio manager may be implemented on a host device (e.g., smartphone, tablet, etc.). In one embodiment, the audio manager manages incoming information from other devices in the ecosystem and selectively routes the information to the appropriate device.

In one embodiment the host device may be a smart appliance 702 or the electronic wearable device may interact with a smart appliance through a host device. The smart appliance 702 may comprise functions allowing interaction with the electronic wearable device 105. For example, the functions may allow for execution of voice commands (e.g., voice command function 731) from the electronic wearable device 105, such as temperature control 732 (raise/lower temperature, turn on/off heat/air conditioning/fan, etc.), lighting control 733 (turn on/off lights, dim lights, etc.), provide current status 734 (e.g., time left for a dishwasher/ washing machine/dryer load, oven temperature or time left for cooking, refrigerator door status, etc.), electronic lock control 735 (e.g., lock/unlock doors or windows adapted to be wirelessly opened/locked), or blind/shade control 736 (e.g., open/close/adjust blinds in windows adapted for wireless control).

In one embodiment, the electronic wearable device 105 may interact with an automobile or vehicle 780 as a host device or through another host device. The automobile or vehicle 780 may comprise functions to facilitate such an interaction. For example, the functions may allow for voice commands 781 to control navigation 782 (e.g., determining directions, route options, etc.), obtain real-time traffic updates 784, control temperature or climate adjustments 783, provide for keyless entry 785 or remote ignition/starting 786, alarm actions (e.g., horn/lights), emergency tracking via GPS, etc.

In one embodiment the electronic wearable device 105 may interface with a smart TV 703 host device or interact with a smart TV through another host device. The smart TV 703 may comprise functions to facilitate the interaction with the electronic wearable device 105. For example, the functions may allow for voice commands to power on or off the TV 742, control channel selection 741, control volume 743, control the input source 744, control TV apps, communicate with a viewer of the smart TV 703, control recordings, etc.

In one embodiment the electronic wearable device 105 may interface with another electronic wearable device 705 (e.g., a wearable wrist device, pendant, etc.) host device or interact with a wearable device through another host device. Such connections or interactions may occur similarly to the computing environment or ecosystem 700 (FIG. 7A) as described above. The other electronic wearable device 705 may comprise functions to facilitate the interaction with the electronic wearable device 105. For example, the functions may allow for voice commands 761 to control or communicate with the electronic wearable device 105, communicate for operating/controlling a media/music player 762 (e.g., receive audio, play audio, etc.) and location services 763 (e.g., determine location, provide directions, map information, etc.). In one example, the wearable device 105 and/or the wearable device 705 may be directly connected with each host device through a communication module (e.g., Bluetooth®, Wi-Fi, Infrared Wireless, Ultra Wideband, Induction wireless, etc.). In another embodiment, the electronic wearable devices 105/705 may interact with other devices through a single host device (e.g., smartphone).

Figure 8:
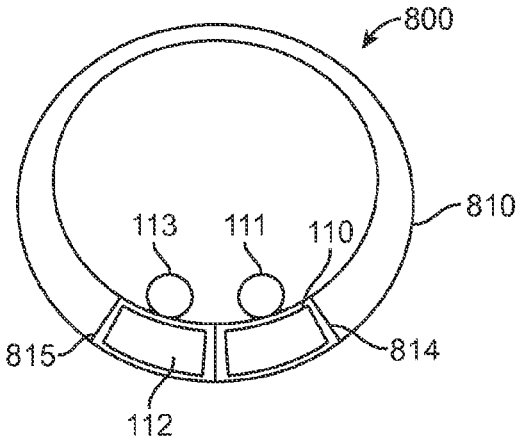
FIG. 8 shows an embodiment of a wearable device that includes electronic components disposed in an audio module connected with the left ear bud and in an audio module connected with the right ear bud, according to an embodiment.

FIG. 8 shows an embodiment of a wearable device 800 that includes an example configuration with electronic components are concentrated in the audio module 110 connected with the left ear bud 111 and in the audio module 112 connected with the right ear bud 113, according to an embodiment. In one example, the band 810 may have a torc shape, collar shape, necklace shape, etc. In one example, the audio module 110 is connected to the band 810 at a connector 814, and the audio module 112 is connected to the band 810 at a connector 815. In one example, the wearable device 800 includes similar features and components as the wearable device 105 (FIGS. 1, 2A, 3), the wearable device system 400 (FIG. 4), the audio module 500 (FIG. 5) and the audio module 600 (FIG. 6), as described above.

In one example, one or more LEDs may be distributed around the band 810 for different functions. In one example, the LEDs may be used for informing a user by using light for alerting to received messaging and notifications. For example, different light patterns or colors may be used for different notifications and messaging (e.g., alerting of particular users based on color or pattern, alerting based on type of message, alerting based on urgency, etc.). In another example, the LEDs may be used for providing light for assisting a user see the wearable device 900 or elements thereof, such as buttons or control areas, instructions or indications on attaching elements, etc. In one example, the LEDs may be used for providing illumination for seeing the surrounding area (e.g., similar as a flash light). In another example, the LEDs may be used for identifying particular users in the dark (e.g., when in a crowd, a particular user may be associated with a particular pattern of lights, colors, etc.).

In one example, the band 810 is swappable with bands made of different material, having different fashion designs, different padding or cushion material (e.g., foam, gel, etc.), different colors, different features, larger or smaller diameter when worn as a necklace, etc.). In one embodiment, haptic elements may be included with the earbud housing of ear bud 111 and/or ear bud 113. In one example, the haptic elements may be used for informing a user of various messages (e.g., notifications, incoming messages (e.g., text messages, voicemail, calls, warnings, etc.)) in one or more haptic patterns using a haptic motor in each of the haptic elements.

Figure 9:
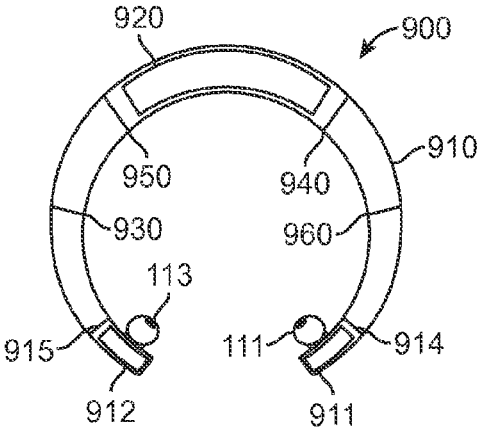
FIG. 9 shows an embodiment of a wearable device that includes electronic components disposed in a band, and includes a housing connected with a left ear bud and another housing connected with the right ear bud according to an embodiment.

FIG. 9 shows an embodiment of a wearable device 900 for an example configuration that concentrates and includes electronic components 920 disposed in a band 910, and includes a housing 911 connected with a left ear bud 111 and a housing 912 connected with the right ear bud 113 according to an embodiment. In one embodiment, the electronic components 920 include components similar to the components of audio module 110 and audio module 112 (FIG. 1, FIG. 2A-C, FIG. 3), audio module 500 (FIG. 5) and audio module 600 (FIG. 6). In one example, the housing 911 includes connections for producing sound at the ear bud 111 and the housing 912 includes connections for producing sound at the ear bud 113. In one embodiment, the housing 911 is connected to the band 910 at the connector or coupling portion 914, and the housing 912 is connected to the band 910 at the connector or coupling portion 915.

In one example, the band 910 may include one or more haptic elements 930, 940, 950 and 960 for informing a user of various messages (e.g., notifications, incoming messages (e.g., text messages, voicemail, calls, warnings, etc.)) in one or more haptic patterns using a haptic motor in each of the haptic elements. It should be noted that while four (4) haptic elements 930, 940, 950 and 960 are shown, any number (e.g., 1, 2, 3, etc.) of haptic elements may be placed around the band 910. In one example, one or more LEDs may be distributed around the band 910 for similar functionality as with band 810 (FIG. 8) as discussed above.

In one example, the band 910 is swappable with bands made of different material, having different fashion designs, different padding or cushion material (e.g., foam, gel, etc.), different colors, different features (e.g., more or less haptic elements, more or less LEDs, larger or smaller diameter when worn as a necklace, etc.).

Figure 10:
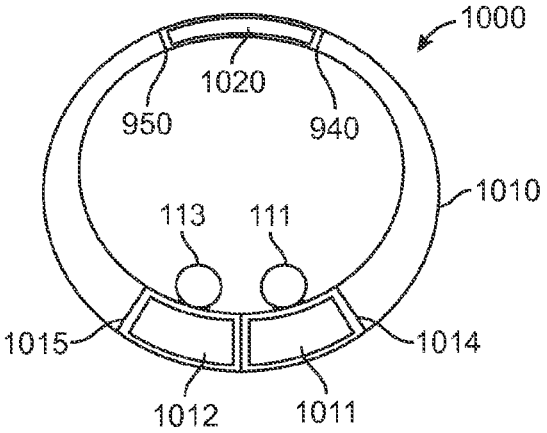
FIG. 10 shows an embodiment of a wearable device including electronic components disposed in a band and electronic components connected with the left ear bud and electronic components connected with the right ear bud, according to an embodiment.

FIG. 10 shows an embodiment of a wearable device 1000 for an example configuration that concentrates electronic components 1020 in a band 1010 and electronic components 1011 connected with the left ear bud 111 and electronic components 1012 connected with the right ear bud 113, according to an embodiment. In one embodiment, the electronic components 1011, 1012 and 1020 may be dispersed so as to include the electronic components as the wearable device 105 (FIGS. 1, 2A, 3), the wearable device system 400 (FIG. 4), the audio module 500 (FIG. 5) and the audio module 600 (FIG. 6), as described above. In one example, the electronic components 1011, 1012 and 1020 distribute the necessary electronic components for a comfortable weight distribution and to reduce slipping of the ear buds 111 and 113 from a user during use.

In one example, the electronic components 1020 may include one or more batteries, the electronic component 1011 may include components of the audio module 500 (FIG. 5), and the electronic component 1012 may include components of the audio module 600 (FIG. 6). It should be noted that other examples may distribute the electronic components differently as desired in order to accommodate an ergonomic fit, feel, weight, etc.

In one example, the band 1010 may include one or more haptic elements 940 and 950 for informing a user of various messages (e.g., notifications, incoming messages (e.g., text messages, voicemail, calls, warnings, etc.)) in one or more haptic patterns using a haptic motor in each of the haptic elements. It should be noted that while two (2) haptic elements 940 and 950 are shown, any number (e.g., 1, 3, 4, etc.) of haptic elements may be placed around the band 1010.

In one example, one or more LEDs may be distributed around the band 1010 for informing a user by light of messaging and notifications, for assisting seeing the wearable device 900 or elements thereof, for seeing the surrounding area, etc.

In one example, the band 1010 is swappable with bands made of different material, having different fashion designs, different padding or cushion material (e.g., foam, gel, etc.), different colors, different features (e.g., more or less haptic elements, more or less LEDs, larger or smaller diameter when worn as a necklace, etc.).

Figure 11:
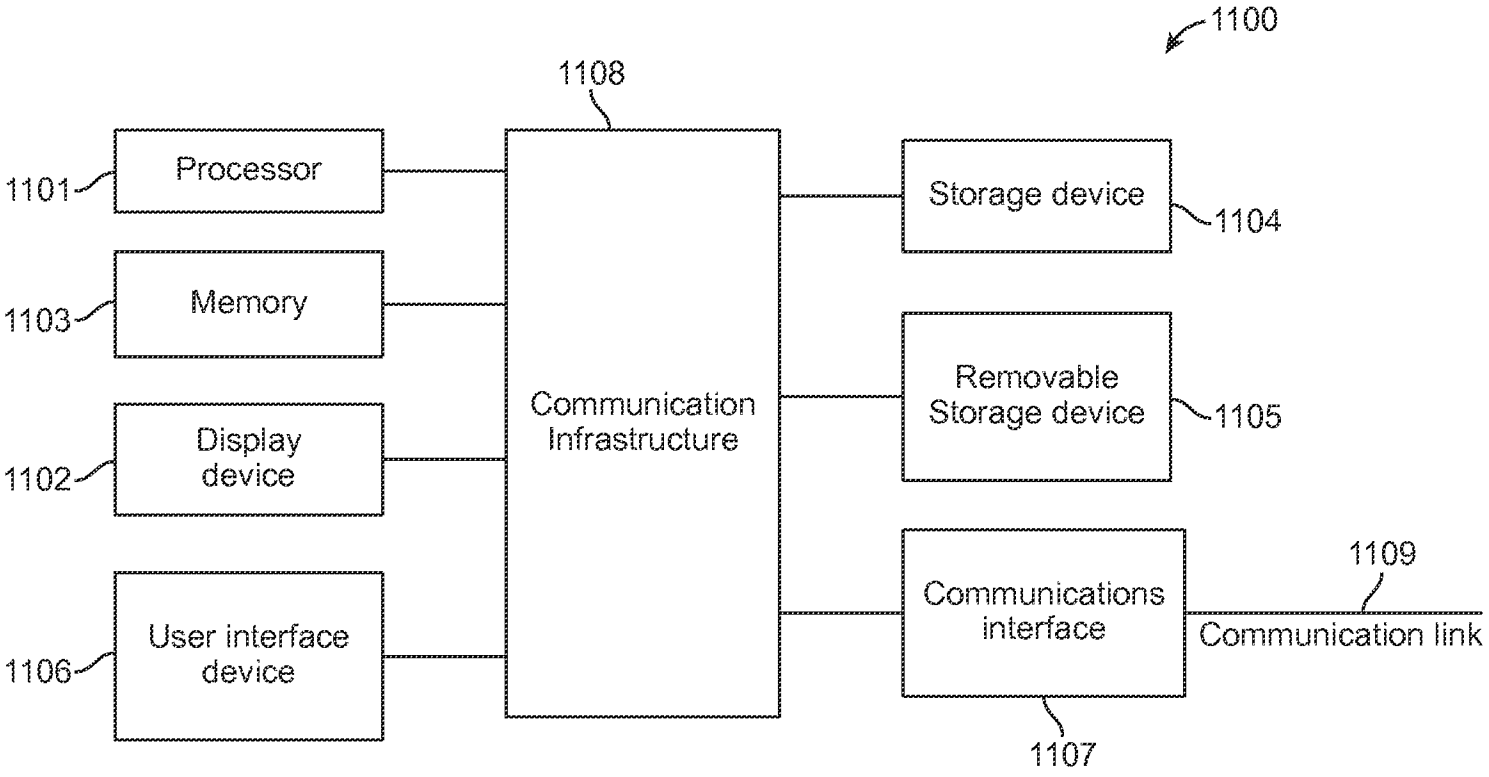
FIG. 11 is a high level block diagram showing a computing system comprising a computer system useful for implementing an embodiment.

FIG. 11 is a high-level block diagram showing an information processing system comprising a computer system 1100 useful for implementing the disclosed embodiments. The computer system 1100 includes one or more processors 1101, and can further include an electronic display device 1102 (for displaying graphics, text, and other data), a main memory 1103 (e.g., random access memory (RAM)), storage device 1104 (e.g., hard disk drive), removable storage device 1105 (e.g., removable storage drive, removable memory module, a magnetic tape drive, optical disk drive, computer readable medium having stored therein computer software and/or data), user interface device 1106 (e.g., keyboard, touch screen, keypad, pointing device), and a communication interface 1107 (e.g., modem, a network interface (such as an Ethernet card), a communications port, or a PCMCIA slot and card). The communication interface 1107 allows software and data to be transferred between the computer system and external devices. The system 1100 further includes a communications infrastructure 1108 (e.g., a communications bus, cross-over bar, or network) to which the aforementioned devices/modules 1101 through 1107 are connected.

Information transferred via communications interface 1107 may be in the form of signals such as electronic, electromagnetic, optical, or other signals capable of being received by communications interface 1107, via a communication link 1109 that carries signals and may be implemented using wire or cable, fiber optics, a phone line, a cellular phone link, an radio frequency (RF) link, and/or other communication channels. Computer program instructions representing the block diagram and/or flowcharts herein may be loaded onto a computer, programmable data processing apparatus, or processing devices to cause a series of operations performed thereon to produce a computer implemented process.

Embodiments have been described with reference to flowchart illustrations and/or block diagrams of methods, apparatus (systems) and computer program products according to embodiments. Each block of such illustrations/diagrams, or combinations thereof, can be implemented by computer program instructions. The computer program instructions when provided to a processor produce a machine, such that the instructions, which execute via the processor, create means for implementing the functions/operations specified in the flowchart and/or block diagram. Each block in the flowchart/block diagrams may represent a hardware and/or software module or logic, implementing embodiments. In alternative implementations, the functions noted in the blocks may occur out of the order noted in the figures, concurrently, etc.

Computer programs (i.e., computer control logic) are stored in main memory and/or secondary memory. Computer programs may also be received via a communications interface. Such computer programs, when executed, enable the computer system to perform the features of the embodiments as discussed herein. In particular, the computer programs, when executed, enable the processor and/or multicore processor to perform the features of the computer system. Such computer programs represent controllers of the computer system.

Though embodiments have been described with reference to certain versions thereof; however, other versions are possible. Therefore, the spirit and scope of the embodiments should not be limited to the description of the preferred versions contained herein.

What is claimed is:

1. An electronic wearable device, comprising:

an electrical cord for carrying electrical signals;

a first audio device having an interface coupled to a first end portion of the first audio device for detachable coupling to the electrical cord;

a second audio device having an interface coupled to a first end portion of the second audio device for detachable coupling to the electrical cord, and a first magnet coupled to a second end portion of the second audio device to magnetically couple the second end portion of the second audio device to a second end portion of the first audio device, wherein the electrical cord is configured to support the first audio device and the second audio device thereon;

a detection device used to detect state configuration of the electronic wearable device;

a controller device for controlling the first audio device and the second audio device; and at least one capacitive area on a surface of the electronic wearable device.

2. The electronic wearable device of claim 1, further comprising an electrical power device having an interface for detachable coupling to the electrical cord;

wherein:

the first audio device comprises a first housing maintaining a first audio transducer; and the second audio device comprises a second housing maintaining a second audio transducer.

3. The electronic wearable device of claim 2, wherein:

the electrical power device is disposed in one of: the first housing, the second housing and the electrical cord; and the controller device is disposed in one of: the first housing, the second housing and the electrical cord.

4. The electronic wearable device of claim 3, further comprising:

a connection device that wirelessly connects to an electronic device; and one or more microphones.

5. The electronic wearable device of claim 4, wherein one or more of the electrical power device, the connection device, the first audio device and the second audio device are swappable with a same or different component.

6. The electronic wearable device of claim 5, wherein the electrical cord is coupled with a swappable band.

7. The electronic wearable device of claim 4, wherein the wearable electronic device communicates with the electronic device for providing hands free control of an ecosystem of content and devices accessible to the wearable device.

8. The electronic wearable device of claim 7, wherein the electronic wearable device provides contextual information based on one or more of user context with the electronic wearable device and information from one or more of the electronic device, a server device and a cloud-based service.

9. The electronic wearable device of claim 7, wherein the electronic device or other devices in the ecosystem comprise one or more of: a smart phone, a tablet, another wearable device, a smart TV, an appliance, and a vehicle.

10. The electronic wearable device of claim 1, wherein:

the detection device comprises at least one sensor; and one of the first audio device and the second audio device comprises the at least one sensor used for sensing proximity of the first audio device with the second audio device.

11. The electronic wearable device of claim 1, wherein:

the detection device comprises one or more sensors;

one or more of the first audio device and the second audio device comprise the one or more sensors; and the one or more sensors are used for determining whether one or more of the first audio device and the second audio device are in use or the wearable device is placed in a necklace configuration.

12. The electronic wearable device of claim 1, wherein the wearable device comprises multiple haptic elements for providing notification patterns using the multiple haptic elements.

13. The electronic wearable device of claim 1, wherein the controller device is coupled to at least one activation element comprising at least one of: a button or a digitizer.

14. A wearable device comprising:

an electrical cord that carries electrical signals;

a first audio device having an interface coupled to a first end portion of the first audio device for detachable coupling to the electrical cord;

a second audio device having an interface coupled to a first end portion of the second audio device for detachable coupling to the electrical cord;

a detection device used to detect state configuration of the wearable device;

a first magnet to magnetically couple the second end portion of the second audio device to a second end portion of the first audio device; and at least one capacitive area on a surface of the wearable device.

15. The wearable device of claim 14, further comprising:

an electrical power device having an interface for detachable coupling to the electrical cord; and a controller device for controlling the first audio device and the second audio device.

16. The wearable device of claim 15, wherein:

the first audio device comprises a first housing maintaining a first audio transducer; and the second audio device comprises a second housing maintaining a second audio transducer.

17. The electronic wearable device of claim 16, wherein:

the electrical power device is disposed in one of: the first housing, the second housing and the electrical cord;

the controller device is disposed in one of: the first housing, the second housing and the electrical cord; and one or more of the electrical power device, the connection device the first audio device and the second audio device are swappable with a same or different component.

18. The electronic wearable device of claim 14, wherein the electrical cord is coupled with a swappable band, and the wearable device comprises multiple haptic elements for providing notification patterns using the multiple haptic elements.

19. The wearable device of claim 14, wherein:

the detection device comprises at least one sensor; and one of the first audio device and the second audio device comprises the at least one sensor.

20. An electronic wearable device, comprising:

an electrical cord for carrying electrical signals;

a first audio device having an interface coupled to a first end portion of the first audio device for detachable coupling to the electrical cord;

a second audio device having an interface coupled to a first end portion of the second audio device for detachable coupling to the electrical cord, and a first magnet coupled to a second end portion of the second audio device to magnetically couple the second end portion of the second audio device to a second end portion of the first audio device, wherein the electrical cord is configured to support the first audio device and the second audio device thereon;

a detection device used to detect state configuration of the electronic wearable device;

a controller device for controlling the first audio device and the second audio device; and a digitizer on a surface of the electronic wearable device.

* * * * *